US006217791B1

(12) United States Patent
Kamakura et al.

(10) Patent No.: US 6,217,791 B1
(45) Date of Patent: Apr. 17, 2001

(54) REFRIGERANT INCORPORATING A POLYOXYALKYLENE GLYCOL MONOMETHYLETHER

(75) Inventors: Tamiji Kamakura; Noriyoshi Tanaka; Yuji Baba; Kimiyoshi Namiwa; Yukio Tatsumi; Masato Namiki, all of Tokyo (JP)

(73) Assignee: Asahi Denka Kogyo K.K., Tokyo (JP)

( * ) Notice: Subject to any disclaimer, the term of this patent is extended or adjusted under 35 U.S.C. 154(b) by 0 days.

(21) Appl. No.: 07/992,177

(22) Filed: Dec. 17, 1992

(30) Foreign Application Priority Data

Dec. 18, 1991 (JP) ..... 3-335055

(51) Int. Cl.[7] ..... C09K 5/00

(52) U.S. Cl. ..... 252/68; 252/67; 252/52 A; 252/52 R

(58) Field of Search ..... 252/52 A, 52 R, 252/68

(56) References Cited

U.S. PATENT DOCUMENTS

| | | | | |
|---|---|---|---|---|
| 4,755,316 | | 7/1988 | Magid et al. | 252/68 |
| 4,900,463 | * | 2/1990 | Thomas et al. | 252/54 |
| 4,916,914 | * | 4/1990 | Short | 252/58 |
| 4,948,525 | * | 8/1990 | Sasaki et al. | 252/52 A |
| 5,037,570 | | 8/1991 | Gorski et al. | 252/54 |
| 5,053,155 | * | 10/1991 | Mahler | 252/68 |
| 5,152,926 | | 10/1992 | Brown | 252/32.5 |

FOREIGN PATENT DOCUMENTS

| | | | | |
|---|---|---|---|---|
| 0 377 122 | | 7/1990 | (EP) . | |
| 0 386 851 | | 9/1990 | (EP) . | |
| 0 402 009 | | 12/1990 | (EP) . | |
| 0 463 773 | | 1/1992 | (EP) . | |
| 533165 | * | 3/1993 | (EP) | C10M/107/34 |
| 1-198694 | | 8/1989 | (JP) . | |
| 1-259093 | | 10/1989 | (JP) . | |
| 1-259095 | | 10/1989 | (JP) . | |
| 1-271491 | | 10/1989 | (JP) . | |
| 2-14894 | | 1/1990 | (JP) . | |
| 2-38481 | | 2/1990 | (JP) . | |
| 2-43290 | | 2/1990 | (JP) . | |
| 2-84491 | | 3/1990 | (JP) . | |
| 2-102296 | | 4/1990 | (JP) . | |
| 2-129294 | | 5/1990 | (JP) . | |
| 2-132176 | | 5/1990 | (JP) . | |
| 2-180987 | | 7/1990 | (JP) . | |
| 2-182780 | | 7/1990 | (JP) . | |
| 2-242888 | | 9/1990 | (JP) . | |
| 2-281098 | | 11/1990 | (JP) . | |
| 2-305893 | | 12/1990 | (JP) . | |
| 3-28296 | | 2/1991 | (JP) . | |
| 3-33193 | | 2/1991 | (JP) . | |
| 3-50297 | | 3/1991 | (JP) . | |
| 3-103496 | | 4/1991 | (JP) . | |
| 3-103497 | | 4/1991 | (JP) . | |
| 3-79696 | | 4/1991 | (JP) . | |
| 3-81396 | | 4/1991 | (JP) . | |
| 3-109492 | | 5/1991 | (JP) . | |
| WO-A-90 05172 | | 5/1990 | (WO) . | |

OTHER PUBLICATIONS

Japanese language publication "Refrigeration" vol. 63, No. 733, p. 1137 and certified translation into English Japanese language publication "High Pressure Gas Technology," N. Sakikawa, editor, Kyouritsu Shuppan K.K., publisher, (1966), pp 82–83 and certified translation into English.

European Office Search Report dated Mar. 22, 1993 for EP–A–92 31 1435.

* cited by examiner

*Primary Examiner*—Necholus Ogden
(74) *Attorney, Agent, or Firm*—Olson & Hierl, Ltd.

(57) ABSTRACT

The object of the present invention is to provide a lubricant for refrigerators having good compatibility with chlorine-free Flon-type coolants, good lubricity and resistant to hygroscopicity and a composition for refrigerators using this lubricant.

This lubricant contains a monomethylether of polyoxyethyleneoxypropyleneglycol where the end group at the hydrogen terminal is an oxyethylene group, represented by the following general formula (1):

$$CH_3O(AO)_m(CH_2CH_2O)_nH$$

wherein the AO group represents oxypropylene group, or copolymeric group of oxypropylene groups and oxyethylene groups wherein the copolymeric form may be a block type and/or a random type, m is a number of $1 \leqq m \leqq 50$, n is a number of $1 \leqq n \leqq 10$, and the content of the oxyethylene group in the compound ranges from 5 to 60 percent by weight. A composition for refrigerators using said lubricant is also provided.

5 Claims, No Drawings

REFRIGERANT INCORPORATING A POLYOXYALKYLENE GLYCOL MONOMETHYLETHER

BACKGROUND OF THE INVENTION i) Field of the Invention

The present invention relates to a lubricant for use in refrigerators and to a composition for use in refrigerators using said lubricant. More specifically, the present invention relates to a lubricant for use in refrigerators employing a chlorine-free Flon-type coolant such as Flon 134a (1,1,2,2,2-tetrafluoroethane), Flon 32 (difluoromethane), Flon 125 (1,1,2,2-pentafluoroethane), Flon 143a (1,1,1-trifluoroethane), Flon 152a (1,1-difluoroethane), Flon 134 (1,1,2,2-tetrafluoroethane), and the like, and a composition for use in refrigerators using said lubricant.

ii) Description of the Related Art

Flon-type coolants have conventionally been excellent for use as a coolant for refrigerators as they are chemically stable and have low toxicity. However, the recent Montreal Protocol decided that among these Flon-type coolants the use of chlorofluorocarbons such as Flon 12 (dichlorodifluoromethane) shall be totally abolished by the year 2000, because chlorofluorocarbons are a source of damage to the ozone layer in the stratosphere and contribute to global warming.

In such circumstances, Flon-type coolants not having chlorine in the molecules thereof, i.e. chlorine-free Flon-type coolants have been developed and are representatively illustrated by Flon 134a, described above, as an alternative to Flon 12.

However, because the polarity of chlorine-free Flon-type coolants without chlorine in molecules thereof such as Flon 134a and the like is higher than Flon 12, these chlorine-free Flon-type coolants have poor compatibility with naphthene mineral oils, alkylbenzene and the like which have been employed as lubricants for refrigerators and cause poor lubricity and frictional wear in the compressors of refrigerators. Therefore, a lubricant having good compatibility with Flon 134a and the like has been sought.

As a lubricant for refrigerators using Flon 134a as a coolant, polyoxyalkylene glycol has been disclosed in U.S. Pat. No. 4,755,316, Japanese Patent Laid-Open Nos. 01-271491, 02-129294, 03-103496 and the like, polyoxyalkylene glycol containing an acyl group as a modified compound of polyoxyalkylene glycol has been disclosed in Japanese Patent Laid-Open Nos. 01-198694, 03-33193, 03-79696, 03-81396 and the like, and polyoxyalkylene glycol containing halogen group has been disclosed in Japanese Patent Laid-Open Nos. 02-180987 and 02-132176.

However, since the above polyoxyalkylene glycols are highly hygroscopic and have poor stability, those modified compounds of polyoxyalkylene glycol have problems with corrosiveness and also, dialkylethers of polyoxyalkylene glycol have poor lubricity, so all of these lubricants have not been practical.

On the other hand, Japanese Patent Laid-Open Nos. 01-259093, 01-259095, 02-43290, 02-84491, 02-102296, 02-182780, 02-242888, 02-277097, 02-281098, 03-50297, 03-103496, 03-103497, 03-50297 and the like disclose monoalkylethers of polyoxyalkylene glycols that have good stability and no corrosive properties and are expected to be practicable.

However, the publicly known monoalkylethers of polyoxyalkylene glycol, described above, still have insufficient lubricity and further have poor compatibility with chlorine-free Flon-type coolants such as Flon 134a and the like.

Accordingly, it is an object of the present invention to provide a lubricant for use in refrigerators having superior compatibility with chlorine-free Flon-type coolants, good lubricity and resistance to hygroscopicity and also a composition for refrigerators using said lubricant.

SUMMARY OF THE INVENTION

The present inventors, as a result of having made various studies regarding lubricants for refrigerators employing chlorine-free Flon-type coolants, have achieved the present invention.

According to the present invention, there is provided a lubricant for use in refrigerators employing a chlorine-free Flon-type coolant whose molecules do not contain chlorine characterized in that said lubricant contains a monoethylether of polyoxyethyleneoxypropyleneglycol where the end group at the hydrogen terminal is an oxyethylene group, and which is represented by the following general formula (1):

$$CH_3O(AO)_m(CH_2CH_2O)_nH$$

wherein the AO group represents an oxypropylene group, or a copolymeric group of oxypropylene groups and oxyethylene groups wherein the copolymeric form may be a block type and/or a random type, m is a number of $1 \leqq m \leqq 50$, n is a number of $1 \leqq n \leqq 10$, and the total content of the oxyethylene groups in the compound ranges from 5 to 60 percent by weight (based on total weight of formula (1) compound).

Further, according to the present invention, there is provided a composition for use in refrigerators characterized in that said composition contains a lubricant containing a monomethylether of polyoxyethyleneoxypropyleneglycol where the end group at the hydrogen terminal is an oxyethylene group, represented by the following general formula (1):

$$(4)\ CH_3O(AO)_m(CH_2CH_2O)_nH$$

wherein the AO groups, and m and n each have their above defined meanings, and the content of oxyethylene groups in the compound remains as above defined, and a chlorine-free Flon-type coolant whose molecules do not contain chlorine, at a weight ratio of from 1:99 to 99:1.

In a compound represented by the general formula (1) described above used in the present invention, one end group should be a methyl group and the other end group should be a hydrogen group because, if hydrocarbyl groups rather than methyl groups are used as one end group, then the resulting lubricant has poor compatibility with Flon 134a, and if both end groups are methyl groups, then lubricity of the resulting lubricant may be deteriorated, and also if both end groups are hydrogen groups, then resistance to hygroscopicity of the resulting lubricants may be deteriorated, so these end groups can not be employed. Flon 134a is here used as being an illustrative and exemplary member of a preferred class of chlorine-free Flon-type coolants for present evaluation and descriptive purposes.

Also, the AO groups in the compound represented by the general formula (1) used in the present invention may be oxypropylene groups, or copolymeric groups of oxypropylene groups and oxyethylene groups wherein the copolymeric form may be block type and/or random type, and the polymerization degree, i.e. m, of said copolymeric group is a number in the range of $1 \leqq m \leqq 50$ and preferably $5 \leqq m \leqq 45$. If said polymerization degree, i.e. m, is over the above range, the resulting lubricants have poor compatibility with Flon 134 and the like.

In the compound represented by the general formula (1) used in the present invention, the end group of the hydrogen terminal should be oxyethylene groups and the polymerization degree, i.e. n, of said oxyethylene groups is a number in the range of $1 \leqq n \leqq 10$, preferably $1 \leqq n \leqq 5$ and more preferably $2 \leqq n \leqq 5$. If the end group of the hydrogen terminal is an oxypropylene group, the lubricity way be deteriorated, and if the polymerization degree of the oxyethylene groups of the end group of the hydrogen terminal is greater than said upper limit, the pour point of the resulting lubricants may be increased.

Further, the total content of the oxyethylene groups in said compound of the general formula (1) should be from 5 to 60 percent by weight and preferably from 10 to 40 percent by weight. If the content of said oxyethylene group is less than said lower limit, the resulting lubricants can not obtain sufficient lubricity, and if the content has higher molecular weight, the resulting lubricants will have poor compatibility with Flon 134a and the like, and also if the content is greater than that range, the pour point of the resulting lubricants will increase.

A compound represented by the general formula (1) used in the present invention can be prepared by well-known processes. For example, said compound can be obtained by polymerizing methanol as a starting material with a mixture having an appropriate ratio of propyleneoxide and ethyleneoxide in the presence of a suitable catalyst and then polymerizing the resulting material with ethyleneoxide.

When in the presence of suitable cataylst, methanol as a starting material is polymerized with mixture of propyleneoxide and ethyleneoxide, the probability that the oxypropylene group will be situated at the end group of the hydrogen terminal is increased since the oxypropylene group has relatively moderate reactivity; therefore, this end group will finally need to be polymerized with ethyleneoxide.

Although it is of course preferable that a lubricant for refrigerators according to the present invention use only a compound having the general formula (1) (that is, a compound having the oxyethylene end group at the hydrogen terminal), commercially there are cases when a compound having an oxypropylene end group of the hydrogen terminal may be included as a contaminant, and, when present said contaminant may be used in amounts of less than 20 molar percent and preferably less than 10 molar percent.

The ratio of oxyethylene groups to another component of a formula (1) compound can be calculated by trifluoroacetylating the oxyethylene group by a conventional method employing trifluoroacetic anhydride and then analyzing said oxyethylene group by NMR (see Analytical Chemistry Vol.38 No.8, 1063~1065, July, 1966).

A lubricant for use in refrigerators according to the present invention preferably comprises substantially at least one compound having the general formula (1), but said lubricant does not prohibit the combination of said compound(s) with at least one of the well-known base oils that are used for refrigerator oil without deviating from the spirit and object of the present invention, and in this case the content of such base oil is preferably less than 50 percent by weight (based on total weight of the resulting composition).

Further, a lubricant for refrigerators according to the present invention may when desired and within the scope of the object of the invention, contain extreme-pressure additives, such as tricreasyl phosphate, trialkylphosphate and the like as well as well-known additive(s) that are ordinarily used in refrigerator lubricants employing Flon-type coolants, such as a stabilizing additive, like for example neopropyleneglycol diglycidylether, polypropyleneglycol diglycidylether, phenyl glycidylether, cycloaliphatic epoxy compound and the like, and an anti-oxidation agent like for example, α-naphtylbenzylamine, phenothiadine, BHT and the like. The content of such additives, when used, should be within a range which is ordinarily adapted in lubricants for refrigerators.

A composition for use in refrigerators according to the present invention may be obtained by mixing a lubricant for refrigerators having the above-specified formula structure and a chlorine-free Flon-type coolant at substantally any weight ratio without any limitation, but said weight ratio may normally be ranged from 1:99 to 99:1. Preferred chlorine-free Flon-type coolants that are useful in the compositions of this invention are fluorine-substituted alkones containing one or two carbon atoms per molecule, a molecular average of at least one fluorine atom per carbon atom (and preferably at least two), and at least one hydrogen atom per molecule, such as Flon 134a (1,1,1,2-tetrafluoroethane), Flon 32 (difluoromethane), Flon 125 (1,1,2,2,2-pentafluoroethane), Flon 143a (1,1,1-trifluoroethane), Flon 152a (1,1-difluoroethane), Flon 134 (1,1,2,2-tetrafluoroethane), and the like.

DESCRIPTION OF PREFERRED EMBODIMENTS

The present invention will now be explained in detail in the following examples, but the invention is not to be limited thereby.

The following Samples 1~10 were used as specimens for the tests. Further, Samples 1~6 were monomethylethers of polyoxyethyleneoxypropyleneglycol according to the present invention and Samples 7~10 were comparative products.

SAMPLE 1

Monomethylether of polyoxyalkyleneglycol represented by the following formula:

$$CH_3O(AO)_{16}(CH_2CH_2O)_2H$$

wherein AO groups represented oxypropylene groups and the ratio of oxyethylene groups in the compound was 9 percent by weight.

SAMPLE 2

Monomethylether of polyoxyalkyleneglycol represented by the following formula:

$$CH_3O(AO)_{14}(CH_2CH_2O)_2H$$

wherein AO groups represented random polymeric groups of oxypropylene groups and oxyethylene groups, and the ratio of oxyethylene groups in the compound was 15 percent by weight.

SAMPLE 3

Monomethylether of polyoxyalkyleneglycol represented by the following formula:

$$CH_3O(AO)_{14}(CH_2CH_2O)_4H$$

wherein AO groups represented random polymeric groups of oxypropylene groups and oxyethylene groups, and the ratio of oxyethylene groups in the compound was 22 percent by weight.

SAMPLE 4

Monomethylether of polyoxyalkyleneglycol represented by the following formula:

$$CH_3O(AO)_{14}(CH_2CH_2O)_8H$$

wherein AO groups represented random polymeric groups of oxypropylene groups and oxyethylene groups, and the ratio of oxyethylene groups in the compound was 34 percent by weight.

SAMPLE 5

Monomethylether of polyoxyalkyleneglycol represented by the following formula:

$$CH_3O(CH_2CH_2O)_7(CH_2\underset{\underset{CH_3}{|}}{C}HO)_{26}(CH_2CH_2O)_3H$$

wherein oxyalkylene groups were block form and the ratio of oxyethylene groups in the compound was 23 percent by weight.

SAMPLE 6

Monomethylether of polyoxyalkyleneglycol represented by the following formula:

$$CH_3O(AO)_{17}(CH_2CH_2O)_2H$$

wherein AO groups represented random polymeric groups of oxypropylene groups and oxyethylene groups, and the ratio of oxyethylene groups in the compound was 41 percent by weight.

SAMPLE 7

Monomethylether of polyoxyalkyleneglycol represented by the following formula:

$$CH_3O(AO)_{16}(CH_2CH_2O)_2H$$

wherein AO groups represented random polymeric groups of oxypropylene groups and oxyethylene groups, and the ratio of oxyethylene groups in the compound was 79 percent by weight.

SAMPLE 8

Monomethylether of polyoxyalkyleneglycol represented by the following formula:

$$CH_3O(AO)_{14}(CH_2CH_2O)_{15}H$$

wherein AO groups represented random polymeric groups of oxypropylene groups and oxyethylene groups, and the ratio of oxyethylene groups in the compound was 49 percent by weight.

SAMPLE 9

Monomethylether of polyoxyalkyleneglycol represented by the following formula:

$$CH_3O(AO)_{25}(CH_2CH_2O)_2H$$

wherein AO groups represented random polymeric groups of oxypropylene groups and oxyethylene groups, and the ratio of oxyethylene groups in the compound was 12 percent by weight.

SAMPLE 10

Monomethylether of polypropyleneglycol represented by the following formula:

$$CH_3O(CH_2\underset{\underset{CH_3}{|}}{C}HO)_{17}H$$

EXAMPLE AND COMPARATIVE EXAMPLE

The Samples 1~10 described above were subjected to tests which were conducted as follows for the purpose of examining solubility to Flon 134a and anti-seizure performance.

Flon 134a Solubility Test:

A mixture of 15 parts by weight of each of the samples and 85 parts by weight of Flon 134a was charged in a 1-liter glass autoclave for the purpose of examining compatibility in a temperature range of −50 to 60° C.

Anti-Seizure Test

The test results are shown in table 1:

A test was conducted on each lubricant (sample) for refrigerators in accordance with ASTM-D3233 using a Falex tester. The anti-seizure test was conducted at an initial oil temperature of 25° C. and after a 5-minute running-in operation at 250 lb.

TABLE 1

| Sample No. | Kinematic Viscostiy at 40° C. (cSt) | Pour Point (° C.) | Ratio of Molecular having Oxyethylene End Group of Hydrogen Terminal (mol %) | Flon-Solubility Test | Anti-Seizure Test Seizure Load (lb) |
|---|---|---|---|---|---|
| 1 (Example) | 53 | −52.5 | 90 | Fully dissolved | 900 |
| 2 (Example) | 43 | −50 | 95 | Fully dissolved | 900 |
| 3 (Example) | 51 | −47.5 | 100 | Fully dissolved | 900 |
| 4 (Example) | 66 | −35 | 100 | Fully dissolved | 950 |
| 5 (Example) | 149 | −42.5 | 92 | Fully dissolved | 1000 |
| 6 (Example) | 50 | −52.5 | 94 | Fully dissolved | 950 |
| 7 (Comp. Example) | 38 | −10 | 90 | Insoluble and deposited lubricant on wall surface at less than −20° C. | — |
| 8 (Comp. Example) | 93 | −2.5 | 100 | Insoluble and deposited lubricant on wall surface at less than −10° C. | — |

TABLE 1-continued

| Sample No. | Kinematic Viscostiy at 40° C. (cSt) | Pour Point (° C.) | Ratio of Molecular having Oxyethylene End Group of Hydrogen Terminal (mol %) | Flon-Solubility Test | Anti-Seizure Test Seizure Load (lb) |
|---|---|---|---|---|---|
| 9 (Comp. Example) | 120 | −35 | 90 | Opaque at more than 40° C. | — |
| 10 (Comp. Example) | 61 | −30.0 | — | Fully dissolved | 550 |

As will be understood from the foregoing description, the present invention provides a lubricant for referigerators and a composition for refrigerators using said lubricant which exhibits superior compatibility with chlorine-free Flon-type coolants which do not contain chlorine in their molecules such as Flon 134a and the like, as well as excellent lubricity and resistance to hygroscopicity.

Thus, the lubricant and the composition of the present invention for use in refrigerators offer the following advantages:

(1) Eliminates troubles in the evaporator of the refrigeration cycle because it exhibits superior compatibility with Flon 134a and the like; and (2) Eliminates troubles in the compressor of the refrigeration cycle because it exhibits superior lubricity.

What is claimed is:

1. A refrigerant composition comprising a fluorinated hydrocarbon coolant and at least one lubricant compound of the formula:

$$CH_3O\ (AO)_m(CH_2CH_2O)_nH$$

wherein

AO is individually selected from the group consisting of oxyethylene and oxypropylene, m is a positive number in the range of 1 through 50 inclusive, provided that when m is 1, AO is oxypropylene and when m is greater than 1, $(AO)_m$ is a polymeric difunctional grouping selected from among members of the class consisting of (a) polymeric groupings of oxypropylene groups and (b) polymeric groupings each consisting of both at least one oxyethylene group and at least one oxypropylene group, n is a positive number in the range of 1 through 10 inclusive, the end group at the hydrogen terminal is an oxyethylene group, and the total content of oxyethylene groups is in the range of 5 through 60 weight percent based on total compound weight, the weight ratio of said coolant to said lubricant compound ranging from 1:99 to 99:1.

2. The composition of claim 1 which is in combination with an oil for a refrigerator.

3. The composition of claim 2 wherein the amount of said oil is less than 50 weight percent on a total composition weight basis.

4. The composition of claim 1 wherein said coolant is a fluorine-substituted alkane containing:

(a) from one through two carbon atoms per molecule, (b) an average of at least one fluorine atom per carbon atom per molecule, and (c) at least one hydrogen atom per molecule.

5. The composition of claim 4 wherein said coolant is selected from the group consisting of 1,1,1,2-tetrafluoroethane, difluoromethane, 1,1,2,2,2-pentafluoroethane, 1,1,1-trifluoroethane, 1,1-difluoroethane, and 1,1,2,2-tetrafluoroethane.

* * * * *

UNITED STATES PATENT AND TRADEMARK OFFICE

CERTIFICATE OF CORRECTION

PATENT NO. : 6,217,791 B1
DATED : April 17, 2001
INVENTOR(S) : Tamiji Kamakura et al.

It is certified that error appears in the above-identified patent and that said Letters Patent is hereby corrected as shown below:

Column 2,
Line 40, delete the formula "(4) $CH_3O\ (AO)_m\ (CH_2CH_2O)_nH$" and insert -- $CH_3O\ (AO)_m\ (CH_2CH_2O)_nH$ --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*